United States Patent [19]

Dijkhuis

[11] 4,352,730

[45] Oct. 5, 1982

[54] METHOD FOR CLEANING A MAGNETIC SEPARATOR AND MAGNETIC SEPARATOR

[75] Inventor: Jacob I. Dijkhuis, TC Zeist, Netherlands

[73] Assignee: Holec N.V., Utrecht, Netherlands

[21] Appl. No.: 228,474

[22] Filed: Jan. 26, 1981

[30] Foreign Application Priority Data

Jan. 30, 1980 [NL] Netherlands ..... 8000579

[51] Int. Cl.[3] ..... B03C 1/02

[52] U.S. Cl. ..... 209/8; 209/11; 209/228; 209/232; 210/222

[58] Field of Search ..... 209/214, 215, 39, 8, 209/232, 223 R, 228, 11; 210/222, 223, 695; 361/149, 267; 335/305; 134/25

[56] References Cited

U.S. PATENT DOCUMENTS

| | | | |
|---|---|---|---|
| 2,678,130 | 5/1954 | Onstad | 209/8 |
| 2,807,363 | 9/1957 | Hendrickson | 209/8 |
| 2,942,162 | 6/1960 | Becker | 361/149 X |
| 3,567,026 | 3/1971 | Kolm | 210/222 |
| 3,838,773 | 10/1974 | Violm | 209/10 |
| 3,859,573 | 1/1975 | Siems | 361/149 X |
| 3,988,240 | 10/1976 | Fraas | 209/217 X |
| 4,087,358 | 5/1978 | Oder | 209/223 R |
| 4,119,500 | 10/1978 | Ishizuka | 361/267 X |
| 4,147,632 | 4/1979 | Oder | 210/222 |
| 4,249,994 | 2/1981 | Dolle | 210/222 X |

OTHER PUBLICATIONS

Min. Eng., Demagnetizing Coils & Magnetic Flocculators used in Magnetite Benefio, Aug. 1968, pp. 58, 59.

Geophys., J. R. Astr. Soc., Jul. 1970, pp. 531–534.

*Primary Examiner*—Ralph J. Hill

*Attorney, Agent, or Firm*—Silverman, Cass & Singer, Ltd.

[57] ABSTRACT

Method for cleaning particles trapped in a filtermatrix of a magnetic separator in the presence of a magnetic field. A cleaning fluid is passed through the filtermatrix which the filtermatrix is heated to a temperature higher than the Curie-temperature of the filtermatrix material.

5 Claims, 7 Drawing Figures

METHOD FOR CLEANING A MAGNETIC SEPARATOR AND MAGNETIC SEPARATOR

BACKGROUND OF THE INVENTION

1. Field of the Invention

This invention relates to a method for removing particles from the filtermatrix of a magnetic separator during the presence of a magnetic field therein, as well as to a magnetic separator. The separator comprises a magnet, an inlet for the material to be filtered, an outlet for cleaned material and a filtermatrix positioned between the input and the output through which the material to be filtered is passed; and which can be cleaned using the method according to this invention.

2. Description of the Prior Art

A method of magnetic separation according to which more magnetic particles are separated from less magnetic particles contained in a fluid medium which is subjected to a magnetic field, is known in itself and e.g. extensively used for cleaning kaolien and metal ore. The filtermatrix material can, e.g. be steelwool and the filtermatrix is placed in an intense magnetic field; the difference in magnetic properties of the particles results in that, dependent upon the field strength, the velocity and viscosity of the fluid and the temperature thereof, certain particles are caught in the filtermatrix and others are not.

This method is e.g. described in IEEE Transactions on Magnetics, Vd. Mag-12, no. 5, September 1976 and in the U.S. Pat. Nos. 3,887,457 and 3,988,240.

With normal magnetic circuits, which dissipate several MW, the generation of a magnetic field strength of up to 2T in a restricted volume is possible. However, certain applications, such as the cleaning of kaolien, catching fly-ash and cleaning metal ores require very high field strength and then superconducting magnets must be used of which the magnetic circuit is cooled with liquid helium.

It is clear that after a certain time of use the filtermatrix is saturated with trapped particles and must be cleaned. However, the structure of known magnetic separators, particularly the magnetic circuit thereof, makes the removal of the filtermatrix and the replacement thereof by a new one during the presence of the magnetic field complicated. When a strong electromagnet, such as a superconducting magnet, is used, the turning off of this magnet, followed by the cleaning of the filtermatrix results in many practical problems. The operation is very timeconsuming; in turning-off a superconducting magnet a considerable amount of helium is lost by evaporation and it requires a considerable amount of energy to bring this helium gas back into the liquid state.

SUMMARY OF THE INVENTION

In view of the foregoing it is a primary object of the present invention to provide a method by means of which the filtermatrix of a separator of the kind described hereinbefore can be cleaned easily without the need of turning-off the magnetic field or removing the filtermatrix from said field.

The invention is based upon the insight that it is possible to temporarily nullify the separating and filtering properties of the filtermatrix, which result from the ferromagnetic properties thereof, by increasing the temperature of the filtermatrix to a value which lies above the Curie-temperature. In that case the filter can be cleaned by a cleaning fluid in the presence of the magnetic field.

According to the invention the method is executed such that a cleaning fluid is passed through the filtermatrix while the filtermatrix is heated to a temperature higher than the Curie-temperature of the filtermatrix material.

The filtermatrix can be heated by using a preheated cleaning fluid which by heat transfer heats the matrix, but it is also possible to heat the matrix by direct heat-supply thereto.

The heating of the filtermatrix can also be effected by passing a current therethrough and loosening of the trapped particles in the filtermatrix is enhanced by bringing the filtermatrix into vibration during the flow of cleaning fluid. This is possible by passing an alternating current through the fluid matrix in such a direction that there is a flow component perpendicular to the direction of the magnetic field.

This invention also aims to provide a magnetic separator comprising a supply for cleaning fluid combined with a heating device to heat the cleaning fluid in such a way that the filtermatrix, by heat transfer from the cleaning fluid thereto, is heated to a temperature which is higher than the Curie-temperature of the filter material.

Another object of this invention is to provide a separator comprising a magnet, an inlet for the material to be filtered, an outlet for cleaned material and a filtermatrix positioned between the input and the output through which the material to be filtered is passed, and further comprising a supply for a cleaning fluid and a heater for directly heating the filtermatrix to a temperature which is higher than the Curie-temperature of the filtermatrix material.

Still another object of this invention is to provide a separator comprising a magnet, an inlet for the material to be filtered, an outlet for cleaned material and a filtermatrix positioned between the input and the output through which the material to be filtered is passed, and having a supply for a cleaning fluid and electrical terminals connected to the filtermatrix and to a current source for passing an electrical current through the filtermatrix.

Preferably the heating current is an alternating current of which the frequency is adapted to the geometric structure and impedance of the filtermatrix filaments.

In a preferred embodiment the filtermatrix is divided into individual sections to be connected into series and parallel circuits to adapt the resistance thereof to the internal resistance of the current source.

The filtermatrix material can be stainless steel, nickel, cobalt or godolinium.

Although the cleaning fluid can be supplied through a separate supply preferably the supply of cleaning medium is combined with the supply for the materials to be filtered.

DESCRIPTION OF A PREFERRED EMBODIMENT

Figure 1:
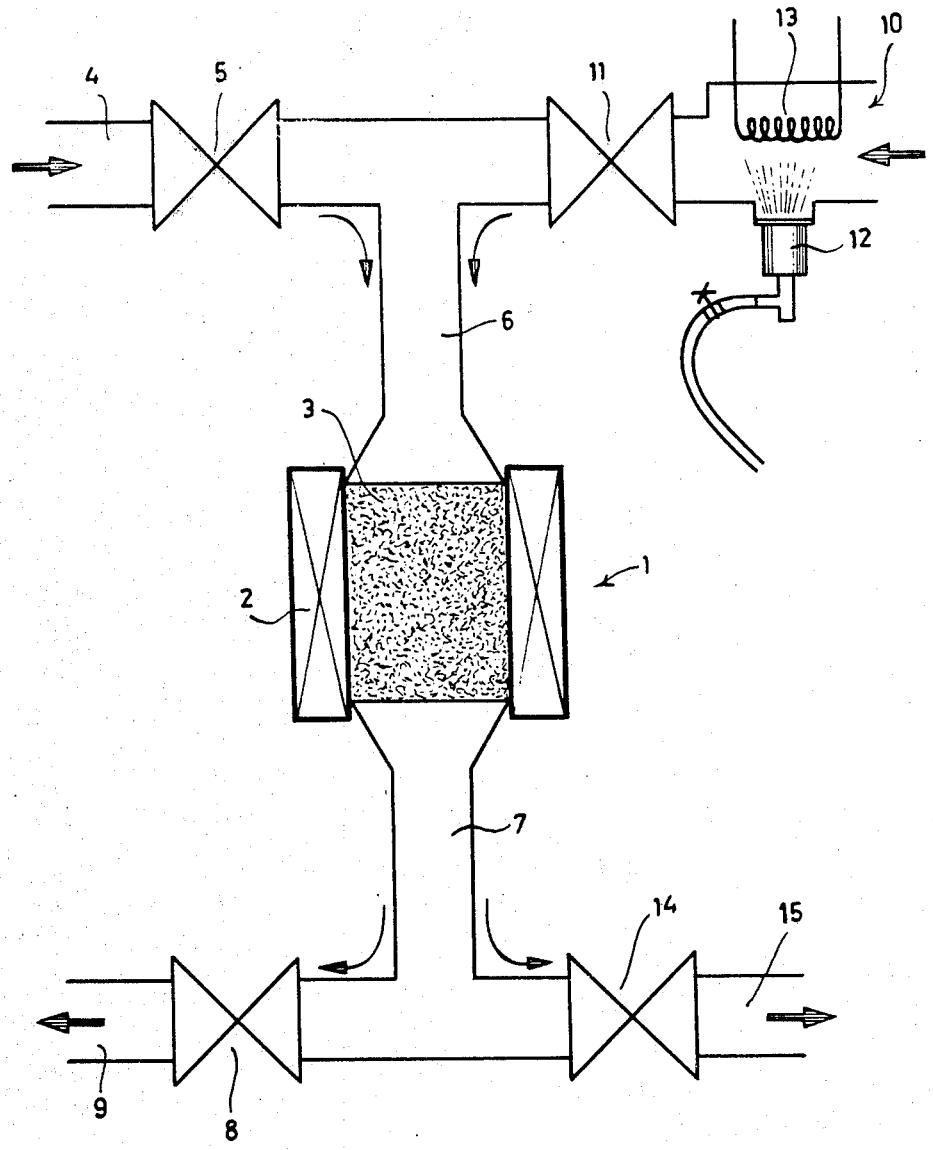
FIG. 1 is a schematic drawing of a first embodiment of a magnetic separator modified for carrying out the method according to the invention.

In FIG. 1 the reference numeral 1 denotes a magnetic separator device of the kind, known in itself, comprising an electromagnet 2, which generates a high magnetic filed across the filtermatrix 3. This filtermatrix is e.g. (stainless) steel, nickel, cobalt or gadolinium.

The fluid containing the particles which are to be filtered out, and also non-magnetic particles, is supplied to the separator 1 through the conduit 4, the valve 5 and the filter inlet 6. In the filtermatrix 3 the magnetic particles are trapped and the fluid with the non-magnetic particles, which have passed through the filtermatrix 3, are discharged through the outlet 7, the valve 8 and the discharge conduit 9.

After prolonged use the filtermatrix is more or less saturated with trapped particles which must be removed. According to the invention this process is carried out in the presence of the magnetic field, so that there is no need to turn off the electromagnet 2. To this end the valve 5 is closed and, through the conduit 10 and the valve 11, a cleaning fluid (which can be the same fluid as the fluid used to transport the particles to be trapped, but which can also be another fluid) is supplied to the inlet conduit; said fluid is heated by means of a schematically indicated burner 12 or a heating helix 13 to such a high temperature that, when the heated fluid flows through the filtermatrix 3 (and is discharged through the outlet 7, the valve 14 and the conduit 15) the material of the filtermatrix is heated to a temperature which lies above the Curie-temperature of the matrix material.

As is well known temperatures higher than the Curie-temperature will cause the material of the filtermatrix to have no magnetic properties so that the particles, trapped therein, are freed and flushed away with the cleaning fluid and discharged through the conduit 15. When the filtermatrix has been cleaned the burner 12 and/or the heating helix 13 are turned off, the valves 11 and 14 are closed, the valves 5 and 8 are opened and a new filtering cycle is started.

Figure 2:
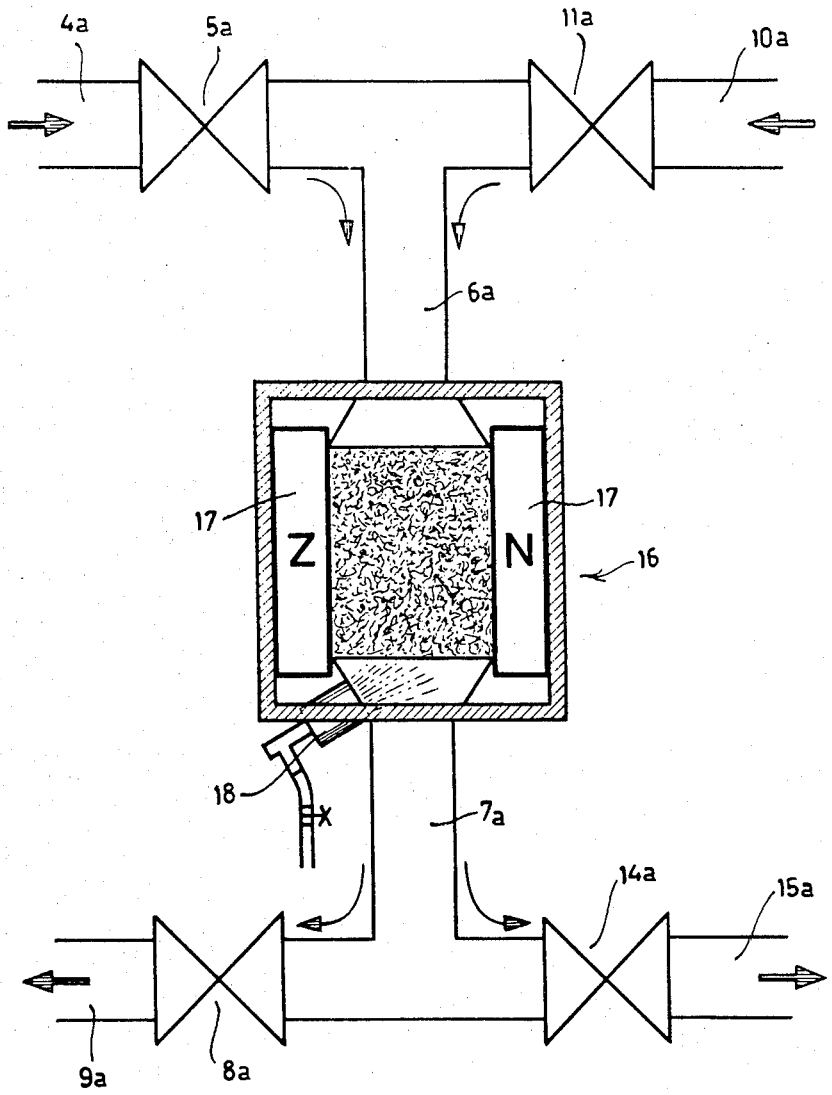
FIG. 2 is a schematic view of a second embodiment.

FIG. 2 shows an embodiment in which parts having the same function and structure as the ones shown in FIG. 1, are indicated by the same reference numerals with the suffix "a" added.

This embodiment uses a separator 16 with a permanent magnet 17; the filtermatrix is heated in another way which can also be used in the embodiment according to FIG. 1.

In this embodiment the filtermatrix can be heated to a temperature higher than the Curie-temperature by means of the burner 18 placed in the housing of the filter 16.

Cleaning of the filter is effected in the same way as described above with reference to FIG. 1.

It is also possible to heat the filtermatrix by passing an electric current therethrough. Direct current or alternating current can be used.

Figure 3A:
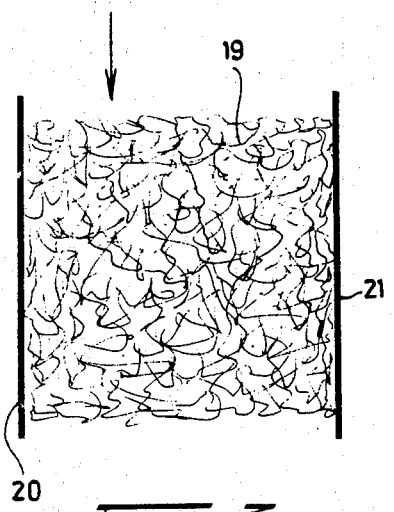
FIG. 3*a* shows schematically a first embodiment of a separator, modified for passing an electric current therethrough.
Figure 3B:
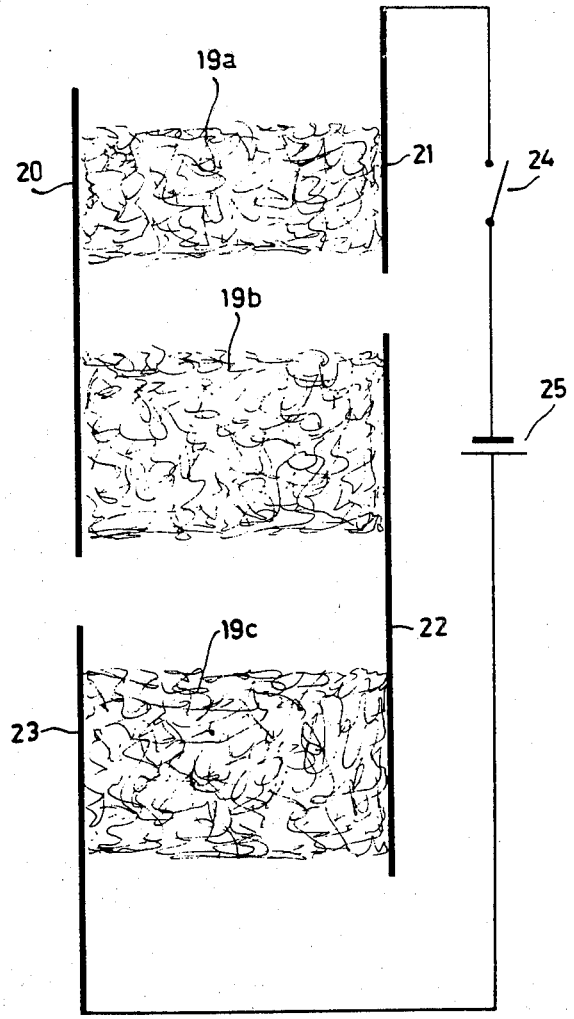
FIG. 3*b* shows a second embodiment of such a filtermatrix.

The FIGS. 3*a* and 3*b* show schematically the structure of a filtermatrix which can be heated by an electric current. FIG. 3*a* is a top view and FIG. 3*b* a side view of such a matrix.

The filter material 19, e.g. steelwool, is placed between a number of plate-like electrodes 20–23. FIG. 3*b* shows how the filtermatrix sections 19*a*, 19*b*, and 19*c* are electrically connected into series via the electrodes 20 and 22. The electrodes 21 and 23 are connected to the current source 25 through the switch 24.

When the filter is operating normally the switch 24 is open and no current passes through the filtermatrices 19*a*, 19*b* and 19*c* which are consequently not heated. When the switch 24 is closed a heating current will flow through the three filtermatrices 19*a*, 19*b*, 19*c* in series and which are thus heated to a temperature higher than the Curie-temperature.

Figure 4A:
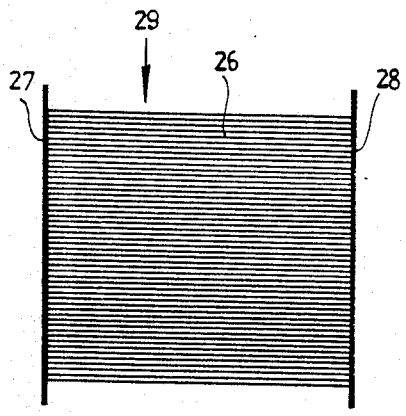
FIG. 4*a* shows schematically another embodiment of a filtermatrix.
Figure 4B:
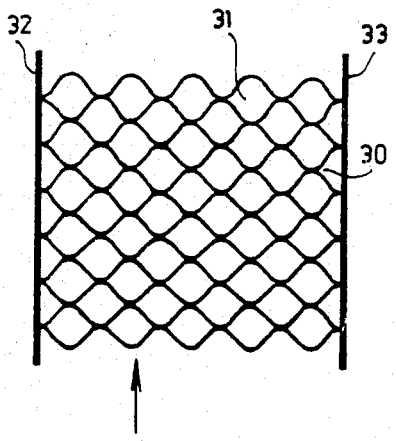
FIG. 4*b* shows schematically still another embodiment of this matrix.
Figure 4C:
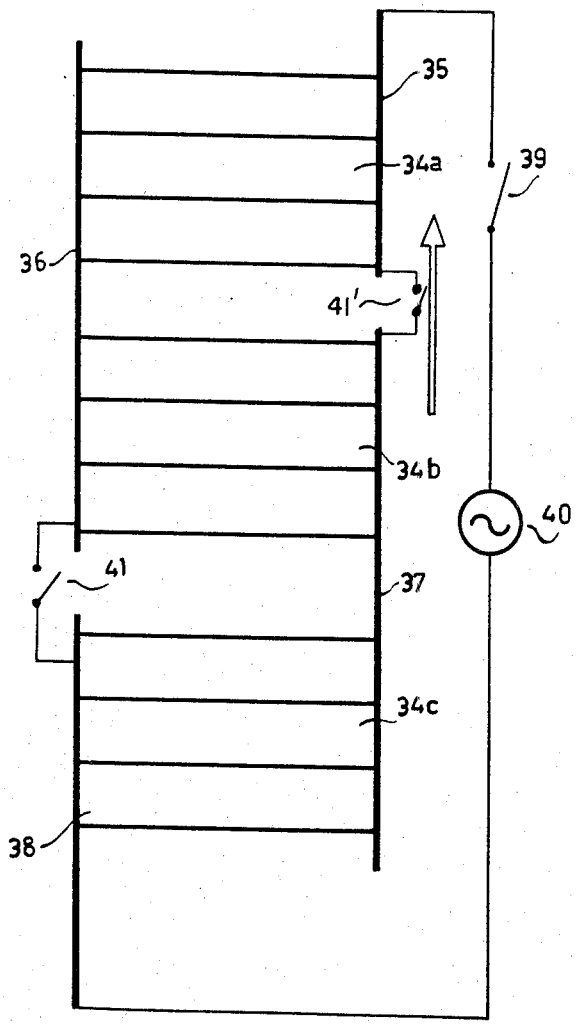
FIG. 4*c* shows schematically an embodiment of a filtermatrix to be connected to an AC current source.

FIG. 4*a* shows schematically the structure of a filtermatrix 26 having matrix material 29 between the electrodes 27 and 28 which consist of thin filaments. FIG. 4*b* shows a structure in which the matrix 30 comprises stretched ribbon material 31 between the electrodes 32 and 33. FIG. 4*c* shows the series circuit of the three sections 34*a*, 34*b*, 34*c* using the electrodes 35, 36, 37 and 38 for conducting the current; the whole structure is connected to the AC current source 40 through the switch 30.

By means of the switches 41 and 41' the sections 34*a* 34*b* and 34*c* can be connected into parallel so that it is possible to adapt the total impedence of the combination of filtermatrices to the internal resistance of the current source 40.

Using an alternating current will not only result in a heating of the sections 34*a*, 34*b*, 34*c* but will also bring the filter material into vibration as a result of the electromagnet forces acting upon this material; amplitude and frequency of the vibration will depend upon the intensity of the current through the filter and the frequency of the alternating current respectively. This vibration results in a more effective cleaning of the filter.

What is claimed is:

1. A magnetic separator comprising a magnet, an inlet for the material to be filtered, an outlet for filtered material, a filtermatrix positioned between the inlet and outlet through which the material to be filtered is passed, a supply of cleaning fluid coupled to the filtermatrix and heater means for heating the filtermatrix to a temperature higher than the Curie temperature, said heater means heating the cleaning fluid to said temperature higher than the Curie temperature and the cleaning fluid heating said filtermatrix to said temperature.

2. The separator as claimed in claim 1 in which said heater means heat the supply of cleaning fluid, the cleaning fluid thereafter being passed through and heating the filtermatrix to said temperature higher than the Curie temperature and said filtermatrix is formed of one of stainless steel, nickel, cobalt and gadolinium.

3. The separator as claimed in claim 2 in which the supply of cleaning fluid is combined with the materials to be filtered.

4. A magnetic separator comprising a magnet, an inlet for the material to be filtered, an outlet for filtered material, a filtermatrix positioned between the inlet and outlet through which the material to be filtered is passed, a supply of cleaning fluid coupled to the filtermatrix and heater means for heating the filtermatrix to a temperature higher than the Curie temperature, said heater means including electrical terminals connected to the filtermatrix and a current source connected thereto for passing an alternating electrical current through the filtermatrix at a frequency adapted to the geometric structure and impedance of the filtermatrix materials.

5. A magnetic separator comprising a magnet, an inlet for the material to be filtered, an outlet for filtered material, a filtermatrix positioned between the inlet and outlet through which the material to be filtered is passed, a supply of cleaning fluid coupled to the filtermatrix and heater means for heating the filtermatrix to a temperature higher than the Curie temperature, the heater means including electrical terminals connected to the filtermatrix and a source connected thereto for passing an electrical current through the filtermatrix, the filtermatrix being formed of several individual sections that are connected together in series and parallel circuits to adapt the resistance thereof to the internal resistance of said current source.

* * * * *